US012172814B2

(12) United States Patent
Smalley

(10) Patent No.: US 12,172,814 B2
(45) Date of Patent: Dec. 24, 2024

(54) CARRIER FOR CONTAINERS

(71) Applicant: Graphic Packaging International, LLC, Atlanta, GA (US)

(72) Inventor: Brian Smalley, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 902 days.

(21) Appl. No.: 16/520,775

(22) Filed: Jul. 24, 2019

(65) Prior Publication Data

US 2020/0031548 A1 Jan. 30, 2020

Related U.S. Application Data

(60) Provisional application No. 62/703,031, filed on Jul. 25, 2018.

(51) Int. Cl.

| | |
|---|---|
| ***B65D 71/58*** | (2006.01) |
| ***B65D 5/42*** | (2006.01) |
| ***B65D 5/46*** | (2006.01) |
| ***B65D 5/48*** | (2006.01) |

(52) U.S. Cl.

CPC ..... *B65D 71/0022* (2013.01); *B65D 5/4266* (2013.01); *B65D 5/46184* (2013.01); *B65D 5/48014* (2013.01); *B65D 2313/10* (2013.01); *B65D 2571/0037* (2013.01)

(58) Field of Classification Search

CPC .. B65D 1/243; B65D 71/0022; B65D 5/4266; B65D 5/45184; B65D 5/48014; B65D 2313/10; B65D 2571/0037; B65D 1/225; B65D 1/23

USPC ..... 206/187

See application file for complete search history.

(56) References Cited

U.S. PATENT DOCUMENTS

| | | | |
|---|---|---|---|
| 1,968,877 | A | 8/1934 | Cubberley |
| 2,222,211 | A | 11/1940 | Arneson |
| 2,225,822 | A | 12/1940 | Crook |
| 2,227,330 | A | 12/1940 | Turner |
| 2,331,312 | A | 10/1943 | Dorfman |
| 2,336,857 | A | 12/1943 | Gies et al. |

(Continued)

FOREIGN PATENT DOCUMENTS

| | | |
|---|---|---|
| CA | 1 229 824 A | 12/1987 |
| CA | 179070 | 6/2019 |

(Continued)

OTHER PUBLICATIONS

Supplementary European Search Report for EP 19 84 2144 dated Mar. 29, 2022.

(Continued)

*Primary Examiner* — Anthony D Stashick
*Assistant Examiner* — L Kmet
(74) *Attorney, Agent, or Firm* — Womble Bond Dickinson (US) LLP

(57) ABSTRACT

A carrier for holding a plurality of containers includes a plurality of panels at least partially extending around an interior space of the carrier, at least one curved corner, and at least one curved divider flap. The plurality of panels includes a front panel, a back panel, at least one side panel, and at least one bottom panel. The at least one curved divider flap extends from the at least one central panel to one of the front panel and the back panel in the interior space of the carrier.

49 Claims, 8 Drawing Sheets

(56) References Cited

U.S. PATENT DOCUMENTS 2,345,746 A 4/1944 Goodyear
2,377,520 A 6/1945 Robinson, Jr.
2,395,711 A 2/1946 Arnold
2,457,308 A 12/1948 Hall et al.
2,460,108 A 1/1949 Smith et al.
2,525,686 A 10/1950 Kowal
2,653,742 A 9/1953 Currie
2,660,361 A 11/1953 Tyrseck
2,687,232 A 8/1954 Arneson
2,689,061 A 9/1954 Gray
2,696,942 A 12/1954 Ringler
2,702,144 A 2/1955 Forrer
2,721,001 A 10/1955 Hasselhoff
2,740,657 A 4/1956 Poupitch
2,754,028 A 7/1956 Morris
2,770,391 A 11/1956 Metzger
2,772,020 A 11/1956 Kramer
2,776,072 A 1/1957 Forrer
2,783,916 A 3/1957 Hodapp
2,794,572 A 6/1957 Goss
2,844,282 A 7/1958 Painter
2,860,816 A 11/1958 Fielding
2,917,202 A 12/1959 Forrer
2,932,424 A 4/1960 Arneson
2,991,908 A 7/1961 Conescu
2,993,619 A 7/1961 Arneson
2,998,899 A 9/1961 Telesca
3,029,977 A 4/1962 Arneson
3,053,411 A 9/1962 Struble et al.
3,128,906 A 4/1964 Forrer
3,166,213 A 1/1965 Holmes
3,168,211 A 2/1965 Petter
3,190,487 A 6/1965 Wood
3,191,800 A 6/1965 Kowal
3,194,478 A 7/1965 Weiss
3,208,632 A 9/1965 Graser
3,208,633 A 9/1965 Graser
3,229,849 A 1/1966 Spillson
3,236,414 A 2/1966 Slevin, Jr.
3,313,466 A 4/1967 Keith
3,343,742 A 9/1967 Siegler
3,352,452 A 11/1967 Graser
3,362,613 A 1/1968 Desmond
3,432,073 A 3/1969 Forrer
3,443,723 A 5/1969 Arneson
3,456,841 A 7/1969 Mahon
3,554,401 A 1/1971 Wood
3,624,790 A 11/1971 Stout
3,651,982 A 3/1972 Slevin
3,661,297 A 5/1972 Wood
3,669,306 A 6/1972 Forrer
3,672,539 A 6/1972 Forrer
3,709,400 A 1/1973 Arneson
3,721,335 A 3/1973 Grant
3,722,738 A 3/1973 Wright
3,739,940 A 6/1973 Harrelson
3,754,680 A 8/1973 Wood
3,757,991 A 9/1973 Stout
3,784,053 A 1/1974 Stout
3,814,238 A 6/1974 Wood
3,860,113 A 1/1975 Helms
3,893,565 A 7/1975 Rossi et al.
3,917,059 A 11/1975 Wood
3,917,060 A 11/1975 Wood
3,917,061 A 11/1975 Stout
4,000,813 A 1/1977 Stout
4,010,847 A 3/1977 Wood et al.
4,029,205 A 6/1977 Wood
D246,633 S 12/1977 Torokvei
4,153,158 A 5/1979 Graser et al.
4,171,046 A 10/1979 Bonczyk
4,187,944 A 2/1980 Wood
4,205,748 A 6/1980 Wilson
4,217,983 A 8/1980 Stout
4,240,546 A 12/1980 Stone
4,243,138 A 1/1981 Wilson
4,250,992 A 2/1981 Gilbert
4,253,564 A 3/1981 Engdahl, Jr.
4,258,844 A 3/1981 Stout
D261,944 S 11/1981 Stone
4,308,950 A 1/1982 Wood
4,318,470 A 3/1982 Montealegre
4,319,682 A 3/1982 Wright et al.
4,362,240 A 12/1982 Elward
4,374,561 A 2/1983 Stout et al.
4,377,252 A 3/1983 Schillinger
4,406,365 A 9/1983 Kulig
4,413,729 A 11/1983 Wood
4,450,956 A 5/1984 Wood
4,469,222 A 9/1984 Graser
4,480,746 A 11/1984 Wood
4,482,055 A 11/1984 Boyle
4,509,640 A 4/1985 Joyce
4,544,092 A 10/1985 Palmer
4,591,090 A 5/1986 Collins et al.
4,610,349 A 9/1986 Schwartz et al.
4,722,437 A 2/1988 Walsh
4,770,294 A 9/1988 Graser
4,782,943 A 11/1988 Blackman
4,782,944 A 11/1988 Engdahl, Jr.
4,792,038 A 12/1988 Cooper
4,927,009 A 5/1990 Stout
5,029,698 A 7/1991 Stout
5,040,672 A 8/1991 DeMaio et al.
5,072,876 A 12/1991 Wilson
5,123,588 A 6/1992 Harris
5,161,732 A 11/1992 Clein et al.
5,167,325 A 12/1992 Sykora
5,191,976 A 3/1993 Stout et al.
5,246,113 A 9/1993 Schuster
5,282,348 A 2/1994 Dampier et al.
5,332,091 A 7/1994 Gugler
5,359,830 A 11/1994 Olson et al.
5,363,954 A 11/1994 Dampier et al.
5,400,901 A 3/1995 Harrelson
5,423,420 A 6/1995 Bakx
5,439,110 A 8/1995 Regan, II
5,458,234 A 10/1995 Harris
5,472,090 A 12/1995 Sutherland
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,542,536 A 8/1996 Sutherland
5,547,074 A 8/1996 Plaxico et al.
5,579,625 A 12/1996 Olson et al.
5,590,762 A 1/1997 Harrelson
5,593,027 A 1/1997 Sutherland
5,611,425 A 3/1997 Holley, Jr.
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,682,985 A 11/1997 Plaxico et al.
5,695,051 A 12/1997 Hart
5,709,298 A 1/1998 Harris
5,765,685 A 6/1998 Roosa
5,775,487 A 7/1998 Harrelson
5,819,920 A 10/1998 Sutherland
5,848,695 A 12/1998 Harris et al.
5,855,316 A 1/1999 Spivey
5,871,090 A 2/1999 Doucette et al.
5,878,877 A * 3/1999 Sutherland ..... B65D 71/0022 206/175
5,884,756 A 3/1999 Holley, Jr. et al.
5,941,377 A 8/1999 Hart et al.
5,947,273 A 9/1999 Dalrymple et al.

(56) References Cited

U.S. PATENT DOCUMENTS

| | | | |
|---|---|---|---|
| 5,979,645 | A | 11/1999 | Holley, Jr. |
| 6,003,665 | A | 12/1999 | Stout |
| 6,041,920 | A | 3/2000 | Hart et al. |
| 6,112,977 | A | 9/2000 | Sutherland et al. |
| 6,131,729 | A | 10/2000 | Eckermann et al. |
| 6,155,962 | A | 12/2000 | Dalrymple et al. |
| 6,168,013 | B1 | 1/2001 | Gomes |
| 6,230,881 | B1 | 5/2001 | Collura |
| 6,247,585 | B1 | 6/2001 | Holley, Jr. |
| 6,315,111 | B1 | 11/2001 | Sutherland |
| 6,321,906 | B1 | 11/2001 | Wein |
| 6,341,689 | B1 | 1/2002 | Jones |
| 6,371,287 | B1 | 4/2002 | Jones et al. |
| 6,571,941 | B2 | 6/2003 | Holley, Jr. |
| D477,530 | S | 7/2003 | von Braun |
| 6,676,583 | B2 | 1/2004 | Walsh |
| 6,695,137 | B2 | 2/2004 | Jones et al. |
| 6,736,260 | B2 | 5/2004 | Gomes et al. |
| 6,802,802 | B2 | 10/2004 | Woog |
| 6,814,228 | B2 | 11/2004 | Sutherland |
| 6,938,756 | B2 | 9/2005 | Schuster |
| D516,439 | S | 3/2006 | Cargile, Jr. |
| 7,011,209 | B2 | 3/2006 | Sutherland et al. |
| 7,025,197 | B2 | 4/2006 | Sutherland |
| 7,070,045 | B2 | 7/2006 | Theelen |
| 7,128,206 | B2 | 10/2006 | Kohler |
| 7,134,547 | B2 | 11/2006 | Auclair |
| 7,207,934 | B2 | 4/2007 | Schuster |
| 7,234,596 | B2 | 6/2007 | Lebras |
| D567,079 | S | 4/2008 | Fant |
| 7,374,038 | B2 | 5/2008 | Smalley |
| 7,448,492 | B2 | 11/2008 | Sutherland |
| 7,472,791 | B2 | 1/2009 | Spivey, Sr. |
| 7,552,820 | B2 | 6/2009 | Kohler |
| 7,604,116 | B2 | 10/2009 | Schuster |
| 7,644,817 | B2 | 1/2010 | Sutherland |
| 7,677,387 | B2 | 3/2010 | Brand et al. |
| 7,762,395 | B2 | 7/2010 | Sutherland et al. |
| 7,762,397 | B2 | 7/2010 | Coltri-Johnson et al. |
| 7,793,780 | B2 | 9/2010 | Smalley |
| 7,959,062 | B2 | 6/2011 | Auclair |
| 8,020,695 | B2 | 9/2011 | Brand |
| 8,297,437 | B2 | 10/2012 | Smalley et al. |
| 8,622,207 | B2 | 1/2014 | Smalley |
| 8,869,979 | B2 | 10/2014 | Smalley |
| 9,061,810 | B2 | 6/2015 | Brand |
| 9,415,914 | B2 | 8/2016 | Holley, Jr. |
| D805,895 | S | 12/2017 | Smalley et al. |
| D805,896 | S | 12/2017 | Smalley |
| 9,963,262 | B2 | 5/2018 | Smalley |
| D826,711 | S | 8/2018 | Boersma et al. |
| 10,124,944 | B2 | 11/2018 | Smalley |
| 10,202,228 | B2 | 2/2019 | Boersma et al. |
| 2002/0077236 | A1 | 6/2002 | Chalendar et al. |
| 2002/0117407 | A1 | 8/2002 | Holley |
| 2003/0111363 | A1 | 6/2003 | Theelen |
| 2003/0159950 | A1 | 8/2003 | Jones et al. |
| 2003/0213705 | A1 | 11/2003 | Woog |
| 2004/0026269 | A1 | 2/2004 | Cuomo |
| 2004/0050722 | A1 | 3/2004 | Schuster |
| 2004/0094435 | A1 | 5/2004 | Auclair et al. |
| 2004/0104134 | A1 | 6/2004 | Skolik |
| 2005/0109639 | A1 | 5/2005 | Cuomo |
| 2005/0167292 | A1 | 8/2005 | Sutherland |
| 2005/0211577 | A1 | 9/2005 | Bakx |
| 2005/0218014 | A1 | 10/2005 | Schuster |
| 2005/0230273 | A1 | 10/2005 | Kohler |
| 2006/0091024 | A1 | 5/2006 | Cuomo |
| 2006/0148629 | A1 | 7/2006 | Cuomo |
| 2006/0157545 | A1 | 7/2006 | Auclair |
| 2006/0231440 | A1 | 10/2006 | Holley, Jr. |
| 2007/0000980 | A1 | 1/2007 | Oliveira |
| 2007/0017828 | A1 | 1/2007 | Cuomo |
| 2007/0017839 | A1 | 1/2007 | Sutherland |
| 2007/0029212 | A1 | 2/2007 | Smalley |
| 2007/0151873 | A1 | 7/2007 | Schuster |
| 2008/0006541 | A1 | 1/2008 | Cherch |
| 2008/0210581 | A1 | 9/2008 | Brand |
| 2008/0265008 | A1 | 10/2008 | Holley |
| 2009/0008273 | A1 | 1/2009 | Smalley |
| 2010/0006458 | A1 | 1/2010 | Wilkins et al. |
| 2010/0072086 | A1 | 3/2010 | Smalley |
| 2010/0320098 | A1 | 12/2010 | Brand |
| 2011/0048975 | A1 | 3/2011 | Brand |
| 2011/0198347 | A1 | 8/2011 | Brand |
| 2012/0000913 | A1 | 1/2012 | Smalley et al. |
| 2014/0291386 | A1 | 10/2014 | Ikeda |
| 2015/0183562 | A1 | 7/2015 | Barkerding |
| 2015/0321816 | A1 | 11/2015 | Holley, Jr. |
| 2016/0051889 | A1 | 2/2016 | Romano |
| 2016/0152389 | A1 | 6/2016 | Holley, Jr. |
| 2017/0190461 | A1 | 7/2017 | Spivey, Sr. |

FOREIGN PATENT DOCUMENTS

| | | |
|---|---|---|
| CA | 179071 | 6/2019 |
| CA | 179486 | 6/2019 |
| DE | 75 03 830 U | 7/1975 |
| DE | 90 04 439 | 6/1990 |
| DE | 201 16 912 U1 | 3/2002 |
| EP | 0 574 653 A1 | 12/1993 |
| EP | 0 579 895 A1 | 1/1994 |
| EP | 0 822 150 | 2/1998 |
| EP | 1 319 607 | 6/2003 |
| EP | 1 454 841 A1 | 9/2004 |
| EP | 1 852 359 | 11/2007 |
| EP | 2 102 073 | 9/2010 |
| FR | 2 825 074 | 11/2002 |
| GB | 926874 | 5/1963 |
| WO | WO 95/09780 A1 | 4/1995 |
| WO | WO 96/12658 A1 | 5/1996 |
| WO | WO 97/05026 | 2/1997 |
| WO | WO 99/01356 | 1/1999 |
| WO | WO 2006/020525 | 2/2006 |
| WO | WO 2008/089124 | 7/2008 |

OTHER PUBLICATIONS

International Search Report and Written Opinion for PCT/US2019/043178 dated Nov. 12, 2019.

* cited by examiner

CARRIER FOR CONTAINERS

CROSS-REFERENCE TO RELATED APPLICATION

This application claims the benefit of U.S. Provisional Patent Application No. 62/703,031, filed on Jul. 25, 2018.

INCORPORATION BY REFERENCE

The disclosure of U.S. Provisional Patent Application No. 62/703,031, which was filed on Jul. 25, 2018, is hereby incorporated by reference for all purposes as if presented herein in its entirety.

BACKGROUND OF THE DISCLOSURE

The present disclosure generally relates to carriers or cartons for holding and displaying containers. More specifically, the present disclosure relates to basket-style carriers that include one or more curved features.

SUMMARY OF THE DISCLOSURE

According to one aspect of the disclosure, a carrier for holding a plurality of containers comprises a plurality of panels at least partially extending around an interior space of the carrier, the plurality of panels includes a front panel, a back panel, at least one side panel, and at least one bottom panel. The carrier further comprises at least one curved corner and at least one curved divider flap extending from the at least one central panel to one of the front panel and the back panel in the interior space of the carrier.

According to another aspect of the disclosure, a blank for forming a carrier for holding a plurality of containers comprises a plurality of panels for at least partially extending around an interior space of the carrier formed from the blank, the plurality of panels includes a front panel, a back panel, at least one side panel, and at least one bottom panel. The blank further comprises at least one corner portion for forming at least one curved corner of the carrier formed from the blank, and at least one divider flap for curvedly extending from the at least one central panel to one of the front panel and the back panel in the interior space of the carrier formed from the blank.

According to another aspect of the disclosure, a method of forming a carrier for holding a plurality of containers comprises obtaining a blank comprising a plurality of panels comprising a front panel, a back panel, at least one side panel, and at least one bottom panel, at least one corner portion, and at least one divider flap. The method further comprises folding the plurality of panels at least partially around an interior of the carrier, curving the at least one corner portion to form at least one curved corner, and positioning the at least one divider flap to curvedly extend from the at least one central panel to one of the front panel and the back panel in the interior space of the carrier.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles) at least partially disposed within the carrier embodiments. In this specification, the terms "lower," "bottom," "upper," "top," "front," and "back" indicate orientations determined in relation to fully erected carriers.

As described herein, cartons can be formed by multiple overlapping panels, portions, and/or end flaps. Such panels, portions, and/or end flaps can be designated in relative terms to one another, e.g., "first", "second", "third", etc., in sequential or non-sequential reference, without departing from the disclosure.

Figure 1:
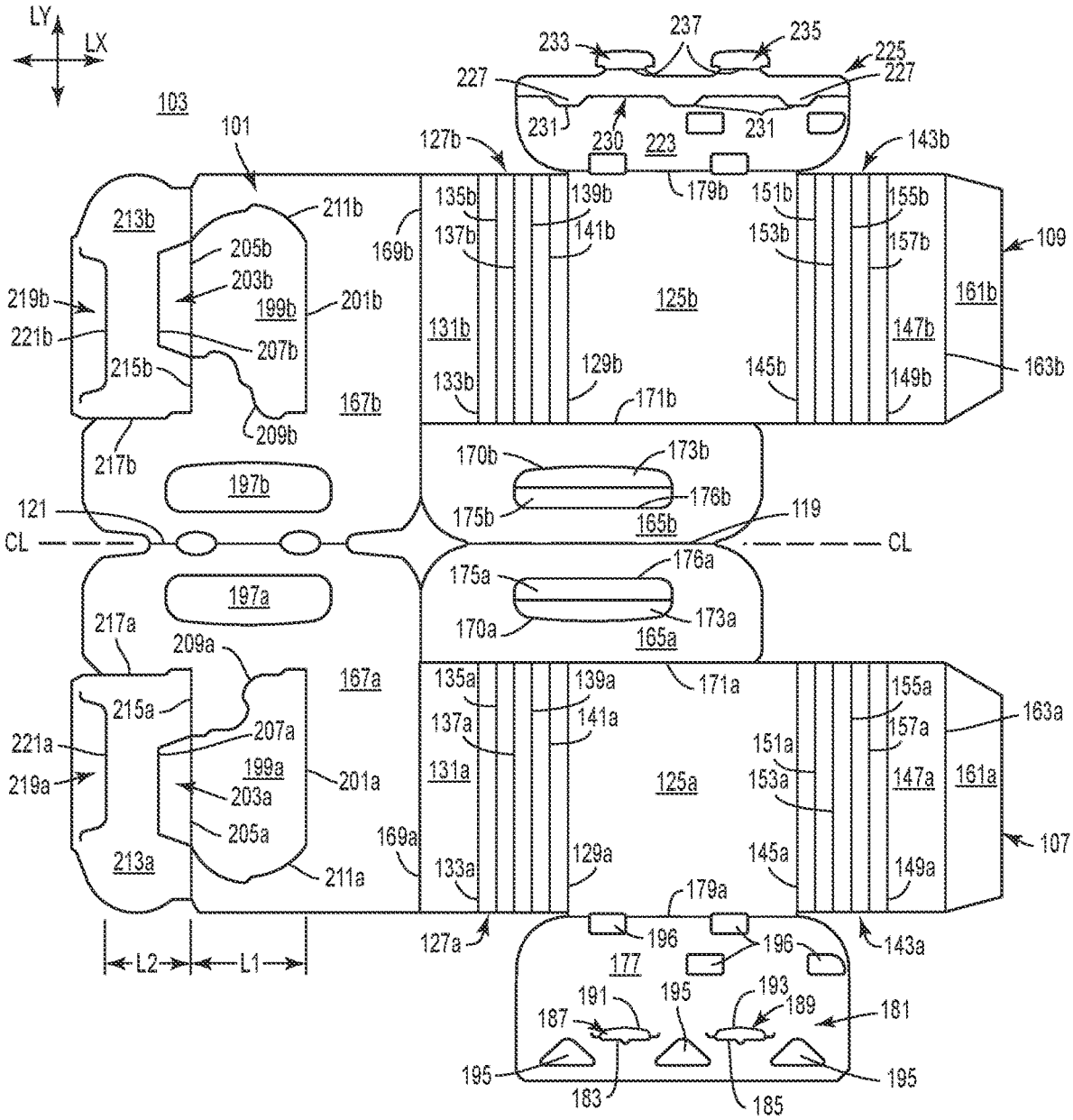
FIG. 1 is a plan view of an exterior surface of a blank for forming a carrier according to an exemplary embodiment of the disclosure.
Figure 4:
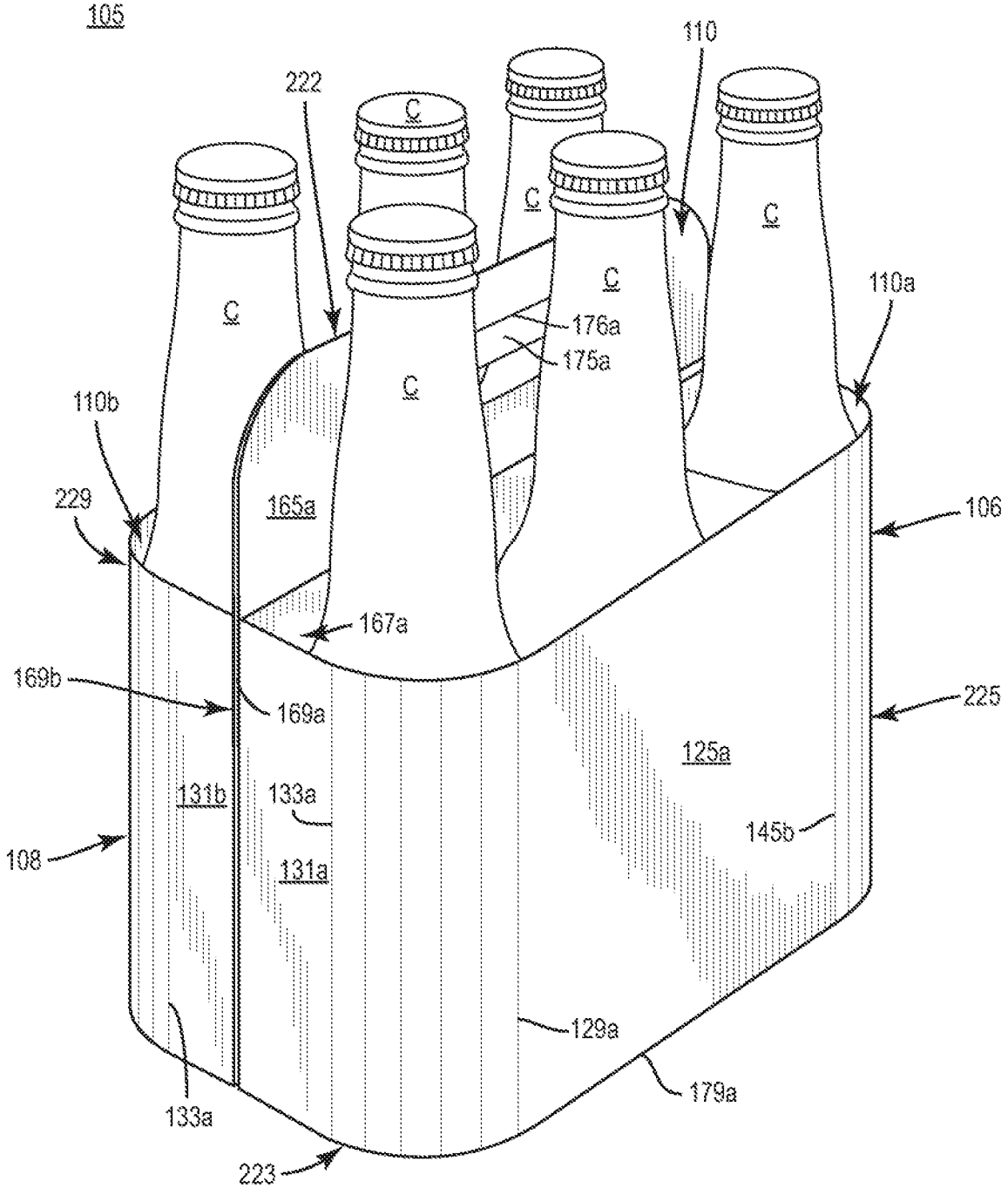
FIG. 4 is a perspective view of a carrier formed from the blank of FIG. 1 according to the exemplary embodiment of the disclosure.
Figure 5:
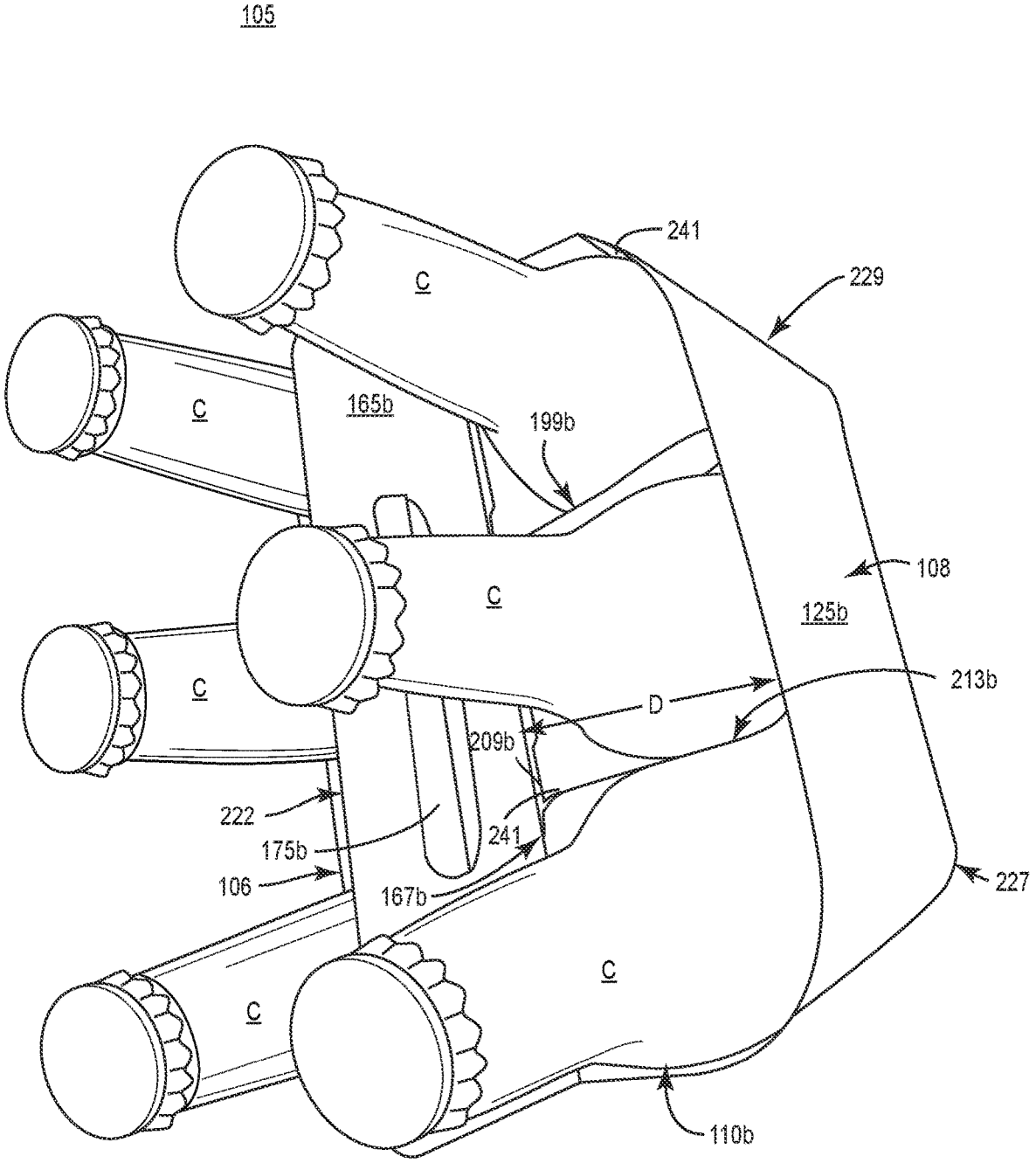
FIG. 5 is an enlarged perspective view of a portion of the carrier of FIG. 4.
Figure 6:
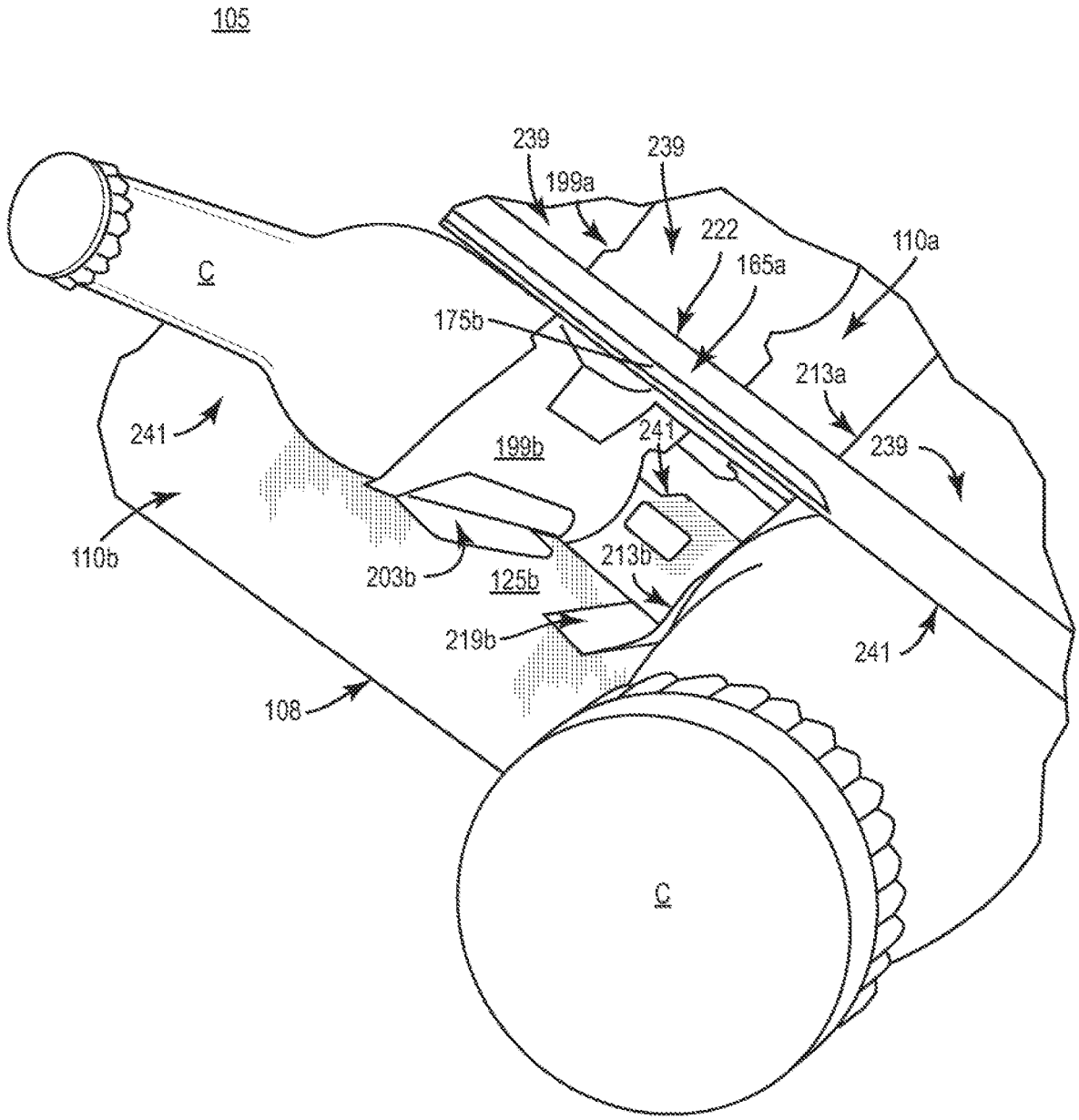
FIG. 6 is an enlarged perspective view of another portion of the carrier of FIG. 4.
Figure 7:
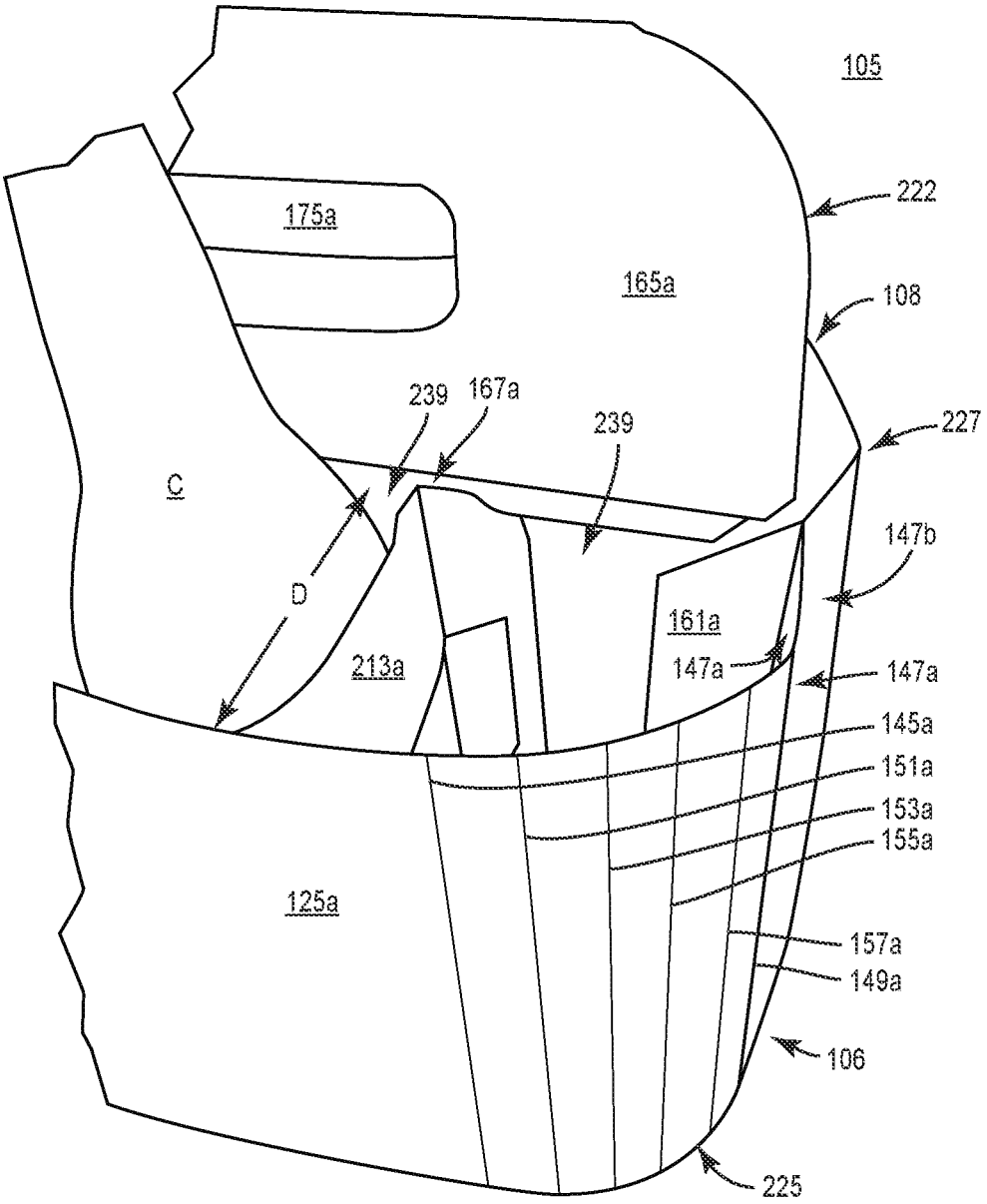
FIG. 7 is an enlarged perspective view of another portion of the carrier of FIG. 4.

FIG. 1 shows a plan view of the exterior side 101 of a blank 103 used to form a package or basket-style carrier 105 (FIG. 4), in accordance with a first exemplary embodiment of the present disclosure. As shown in FIG. 4, the carrier 105 is sized to contain six containers C, three containers C being contained in a front portion 106 of the carrier 105 and three containers C being contained in a back portion 108 of the carrier 105. As described herein, the carrier 105 has generally curved divider flaps 199*a*, 199*b*, 213*a*, 213*b* (broadly, "first curved divider flap", "second curved divider flap" or "third curved divider flap", "second curved divider flap", and "fourth curved divider flap", respectively) that are at least partially reconfigurable to a generally curved configuration, and is provided with generally curved corners 223,

225, 227, 229 (broadly, "first curved corner", "second curved corner", "third curved corner", and "fourth curved corner", respectively) (FIG. 8) that provides a distinctive configuration of the carrier 105. In the illustrated embodiment, the containers C can be beverage bottles, but the containers C could be any other suitable type and size of container without departing from the disclosure. The carrier 105 can be sized and shaped to hold more or less than six containers C. In one embodiment, the front portion 106 and the back portion 108 of the carrier 105 each have three containers C. In other embodiments, the front portion 106 and the back portion 108 of the carrier 105 can hold more or less than three containers C without departing from the disclosure.

As illustrated in FIG. 1, the blank 103 has a longitudinal axis LX and a lateral axis LY. The blank 103 has a front portion 107 for forming the front portion 106 of the carrier 105, and a back portion 109 for forming the back portion 108 of the carrier 105. In one embodiment, the front portion 107 and the back portion 109 intersect at the longitudinal centerline CL of the blank 103, as shown. As discussed in further detail below, the blank 103 is at least partially formed into the carrier 105 by folding the blank 103 about fold lines 119, 121 along the centerline CL so that the front portion 107 and the back portion 109 of the blank 103 are overlapped in at least partial face-to-face contact.

Figure 8:
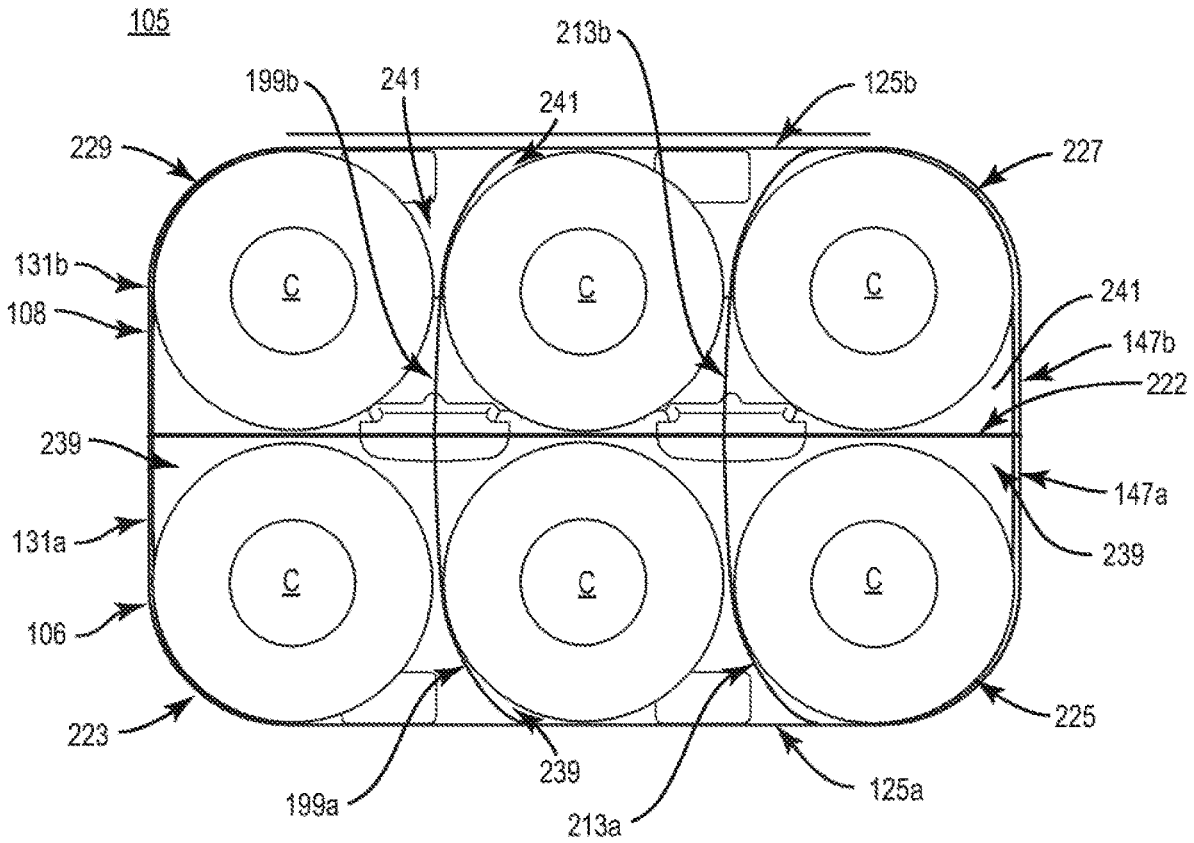
FIG. 8 is a plan view of the carrier of FIG. 4.

In the illustrated embodiment, the front portion 107 of the blank 103 comprises a front panel 125*a* and a first corner portion 127*a* foldably connected to the front panel 125*a* at a lateral fold line 129*a*. A first front side panel 131*a* is foldably connected to the corner portion 127*a* at a lateral fold line 133*a*. The corner portion 127*a*, as shown, includes a plurality of lateral fold lines 135*a*, 137*a*, 139*a*, 141*a* such that the corner portion 127*a* defines a flexibly reconfigurable portion of the blank 103 for forming the first curved corner 223 of the carrier 105 (FIG. 8). In one embodiment, the plurality of lateral fold lines that form the first curved corner 223 of the carrier 105 can include one or both of the lateral fold lines 129*a*, 133*a*. While the corner portion 127*a* has been described as a portion of the blank 103 that is foldably connected to each of the side panel 131*a* and the front panel 125*a*, the corner portion 127*a* can be a portion of one or both of the side panel 131*a* and the front panel 125*a* without departing from the disclosure.

The front portion 107 of the blank 103 also includes a second corner portion 143*a* foldably connected to the front panel 125*a* at a lateral fold line 145*a* and a second front side panel 147*a* foldably connected to the corner portion 143*a* at a lateral fold line 149*a*. The corner portion 143*a*, as shown, includes a plurality of lateral fold lines 151*a*, 153*a*, 155*a*, 157*a* such that the corner portion 143*a* defines a flexibly reconfigurable portion of the blank 103 for forming the second curved corner 225 of the carrier 105 (FIG. 8). In one embodiment, the plurality of lateral fold lines that form the second curved corner 225 of the carrier 105 can include one or both of the lateral fold lines 145*a*, 149*a*. While the corner portion 143*a* has been described as a portion of the blank 103 that is foldably connected to each of the side panel 147*a* and the front panel 125*a*, the corner portion 143*a* can be a portion of one or both of the side panel 147*a* and the front panel 125*a* without departing from the disclosure. A keel 161*a* (broadly, "first keel"), as shown, is also foldably connected to the second side panel 147*a* at a lateral fold line 163*a*.

As shown in FIG. 1, the front portion 107 of the blank 103 also includes handle features for forming a handle 222 of the carrier 105 and that include a front handle reinforcement flap 165*a* foldably connected to a central panel 167*a* at portion of a lateral fold line 169*a* and separated from the front panel 125*a*, the corner portion 127*a*, and the first front side panel 127*a* by a longitudinal cut 171*a*. The front handle reinforcement flap 165*a* includes an opening 173*a* and a handle flap 175*a* adjacent to the opening 173*a* that is separable from the handle reinforcement flap 165*a* at a generally elongate U-shaped cut line 170*a* and foldably connected to the handle reinforcement flap 165*a* at a line of weakening 176*a*.

The front portion 107 of the blank 103, as shown in FIG. 1, also includes a front bottom panel 177 foldably connected to the front panel 125*a* at a longitudinal fold line 179*a*. In one embodiment, the bottom panel 177 includes female locking features 181. The female locking features 181, as shown, include respective slits 183, 185 that partially define respective opening flaps 187, 189 foldably connected to the bottom panel 177 along respective curved fold lines 191, 193. The slits 183, 185 and respective opening flaps 187, 189 cooperate to receive respective secondary locking tab projections 233, 235 of a back bottom panel 223 of the back portion 109 of the blank 103, as described herein. The female locking features 181 also include openings 195 that receive primary locking tab projections 227 of the back bottom panel 223 of the back portion 109 of the blank 103, as described herein. Additional openings or apertures 196 can be provided in the front bottom panel 177, for example, for ventilation, drainage of condensation or other moisture, and/or to provide visibility to bottom portions of containers held in the carrier 105.

In the embodiment shown in FIG. 1, and as described above, the front central panel 167*a* is foldably connected to the first front side panel 127*a* at a portion of the lateral fold line 169*a*. The central panel 167*a* also includes additional handle features including a handle opening 197*a*. As shown in FIG. 1, a first divider flap 199*a* is foldably connected to the central panel 167*a* at a lateral fold line 201*a*. An attachment flap 203*a* is foldably attached to the divider flap 199*a* at a lateral fold line 205*a*. The attachment flap 203*a* is at least partially separable from a second divider flap 213*a* at a lateral line of weakening 207*a*. The divider flap 199*a*, as shown, is at least partially separable from the remainder of the central panel 167*a* at lines of weakening 209*a*, 211*a* that each extend from respective endpoints of the lateral fold line 201*a* to respective endpoints of the line of weakening 207*a*. One or both of the lines of weakening 209*a*, 211*a*, as shown, can include one or more curved or angled portions.

As also shown, the second divider flap 213*a* is foldably connected to the central panel 167*a* at a lateral fold line 215*a* that is interrupted by the attachment flap 203*a*. The second divider flap 213*a* is at least partially separable from the central panel 167*a* at a line of weakening 217*a* that extends from an endpoint of the fold line 215*a* to a free edge of the blank 103, and an attachment flap 219*a* is at least partially defined adjacent the divider flap 213*a* by a line of weakening 221*a* that can include one or more curved or angled portions. As described herein, the attachment flap 219*a* can be at least partially foldably or hingedly connected to the divider flap 213*a* at one or more portions of the line of weakening 221*a*.

In one embodiment, the divider flaps 199*a*, 213*a* have respective lengths L1, L2 that correspond to a longitudinal distance from the respective lateral fold line 201*a* to the fold line 205*a*, and from the fold line 215*a* to a lateral portion of the line of weakening 221*a*. The central panel 167*a* could be otherwise shaped, arranged, and/or configured, and could have other features, without departing from the disclosure.

In the illustrated embodiment, the features of the back portion 109 of the blank 103 include, for example, a back panel 125*b*, a first back side panel 131*b*, a second back side panel 147*b*, a back keel 161*b* (broadly, "second keel"), a back central panel 167*b*, a third corner portion 143*b*, a fourth corner portion 127*b*, a reinforcement flap 165*b*, a first divider flap 199*b*, and a second divider flap 213*b* having associated features such that the back portion 109 of the blank 103 is generally a mirror-image of the corresponding panels, flaps, and portions of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103.

As shown in FIG. 1, and in contrast to the front portion 107, the back portion 109 of the blank 103 includes a back bottom panel 223 having male locking features 225 and being foldably connected to the back panel 125*b* at the longitudinal fold line 179*b*. The male locking features 225 include the primary locking tab projections 227 that are at least partially defined along a line of weakening 230 of the bottom panel 223, as shown. The projections 227 can be formed by tears or cuts 231 that extend between portions of the line of weakening 230. As described herein, the primary locking tab projections 227 are at least partially insertable through the openings 195 in the bottom panel 177. The male locking features 225, as shown, also include the secondary locking tab projections 233, 235 that are foldably connected to the bottom panel 223 at fold lines 237 and are at least partially insertable through the respective slits 183, 185 and/or openings formed by the respective opening flaps 187, 189 of the front bottom panel 177, as described herein.

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

Figure 2:
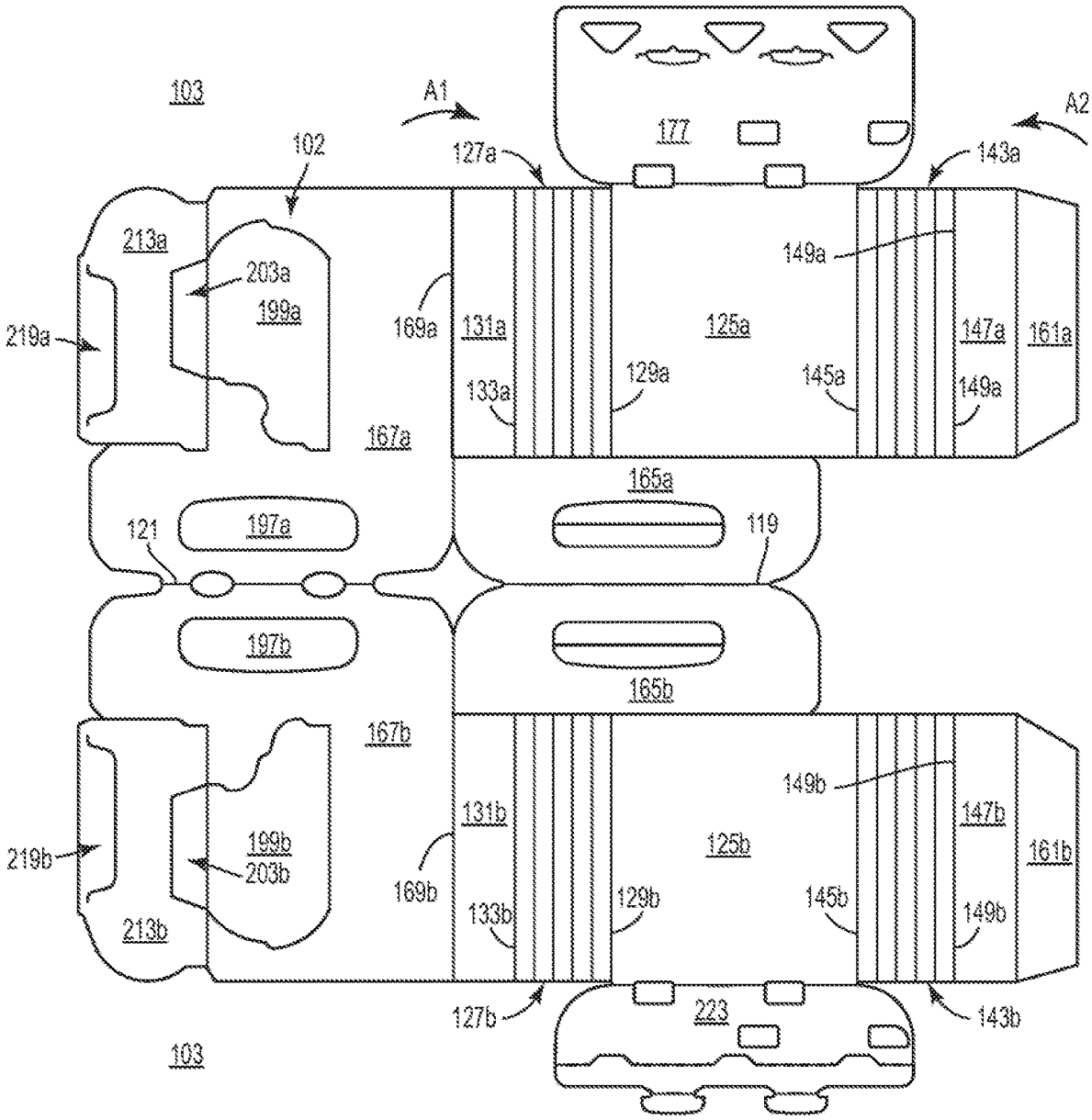
FIG. 2 is a plan view of a partially folded configuration of a carrier folded from the blank of FIG. 1.
Figure 3:
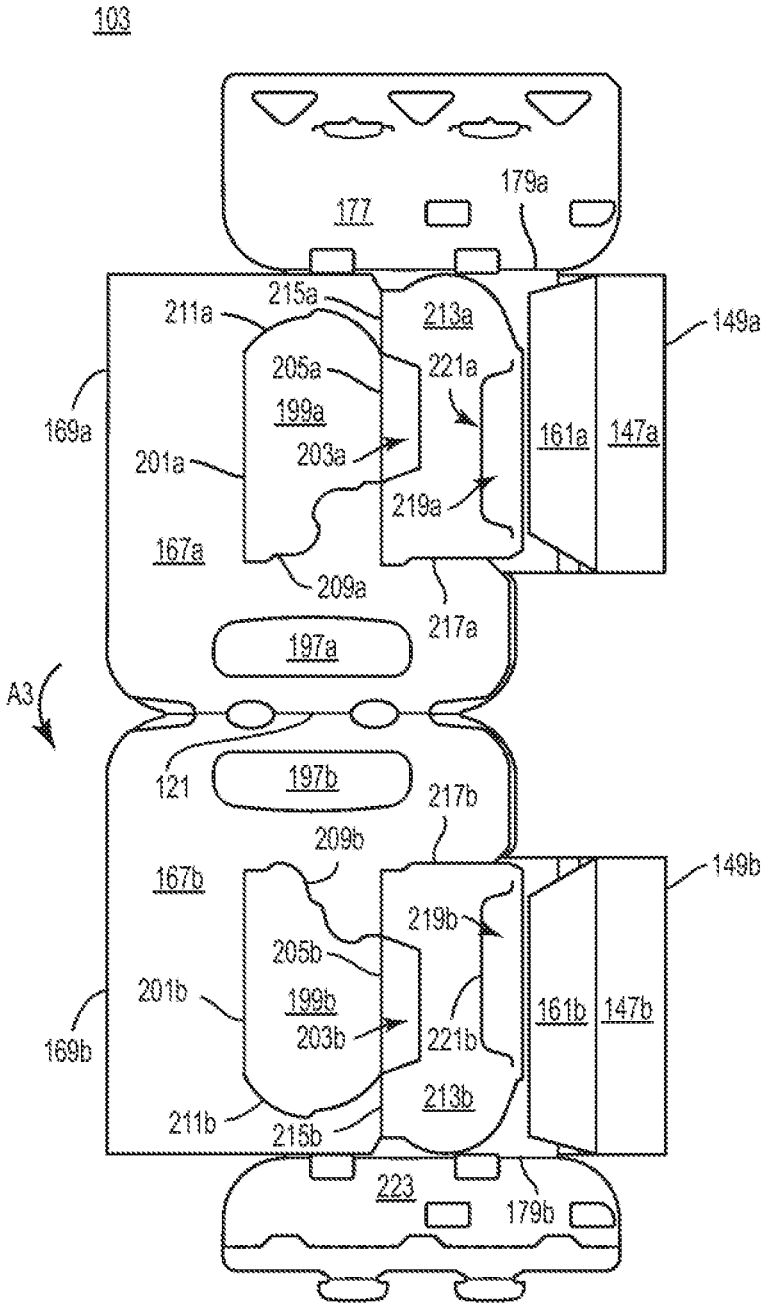
FIG. 3 is a plan view of another partially folded configuration of a carrier folded from the blank of FIG. 1.

Still referring to FIG. 1, and referring additionally to FIGS. 2-4, in one embodiment, the carrier 105 can be formed or erected by obtaining the blank 103 and placing or positioning the blank 103 with the exterior surface 101 facing down and an exterior surface 102 of the blank 103 facing upward. The front central panel 167*a* and the back central panel 167*b* can be folded at the respective fold lines 169*a*, 169*b* in the direction of the arrow A1 such that one or more portions of the central panels 167*a*, 167*b* are positioned in at least partial face-to-face contact with one or more portions of the respective side panel 131*a*, 131*b*, respective corner portions 127*a*, 127*b*, respective central panels 125*a*, 125*b*, and respective handle reinforcement flaps 165*a*, 165*b*. Such folding can position at least the respective attachment flaps 203*a*, 219*a* and 203*b*, 219*b* in at least partial face-to-face contact with portions of the respective central panels 125*a*, 125*b*, and which can be adhered thereto with an adhesive such as glue.

Thereafter or simultaneously, the respective side panels 147*a*, 147*b* can be folded at the respective fold lines 149*a*, 149*b* in the direction of the arrow A2 such that the side panel 147*a* and the keel 161*a* carried therewith are positioned in at least partial face-to-face contact with respective portions of the corner portion 143*a* and the central panel 125*a*, and such that the side panel 147*b* and the keel 161*b* carried therewith are positioned in at least partial face-to-face contact with respective portions of the corner portion 143*b* and the central panel 125*b*. Such folded configuration is illustrated in FIG. 3.

The front portion 107 of the blank 103 and the back portion 109 of the blank 103 can be folded at the fold lines 119, 121 in the direction of the arrow A3 into at least partial face-to-face contact, and at least the respective central panels 167*a*, 167*b* and respective keels 161, 161*b* can be maintained in such relation with an adhesive such as glue. Such folded configuration is illustrated in FIG. 3.

Referring additionally to FIGS. 4-8, the front panel 125*a* and the back panel 125*b* can be separated from one another into at generally parallel relation and such that the corner portions 127*a*, 143*a*, 143*b*, 127*a* flex, bend, and/or curve at least at the respective plurality of fold lines 135*a*, 137*a*, 139*a*, 141*a*, the plurality of fold lines 151*a*, 153*a*, 155*a*, 157*a*, the plurality of fold lines 151*b*, 153*b*, 155*b*, 157*b*, and the plurality of fold lines 135*b*, 137*b*, 139*b*, 141*b* to form the respective curved corners 223, 225, 227, 229 of the carrier 105. In such a configuration, the keels 161*a*, 161*b* are brought into proximity with but maintained in substantially coplanar separation with the marginal portion of the respective central panels 167*a*, 167*b* to be spaced apart therefrom. The handle reinforcement flaps 165*a*, 165*b* are overlapped in at least partial face-to-face contact on an upper portion of the respective central panels 167*a*, 167*b* such that the openings 173*a*, 173*b* of the respective handle reinforcement flaps 165*a*, 165*b* are aligned with the respective openings 197*a*, 197*b* of the respective central panels 167*a*, 167*b* to form a handle 222 of the carrier, with the keels 161*a*, 161*b* positioned therebelow. As the keels 161*a*, 161*b* are disposed below the handle 222 and are spaced apart from the handle 222 so as to not form a part thereof, significant material savings can be recognized as compared to, for example, a carrier for a handle that includes one or more upwardly-extending portions of a keel.

In such an arrangement, an interior space 110 of the carrier 105 is defined, with a front interior space 110*a* of the carrier 105 in the front portion 106 of the carrier 105 between the front panel 125*a* and the central panel 167*a*, and a back interior space 110*b* of the carrier 105 in the back portion 108 of the carrier 105 between the back panel 125*b* and the central panel 167*b*.

As shown, the divider flaps 199*a*, 213*a* are folded away from the remainder of the central panel 167*a* and separated from one another along portions of the respective lines of weakening 209*a*, 207*a*, 211*a*, 217*a*, and the divider flaps 199*b*, 213*b* are folded away from the remainder of the central panel 167*b* and separated from one another along portions of the respective lines of weakening 209*b*, 207*b*, 211*b*, 217*b*. In such an arrangement, the divider flaps 199*a*, 213*a* extend from the central panel 167*a* to the front panel 125*a* and the attachment flaps 203*a*, 219*a* are folded into at least partial face-to-face contact with the front panel 125*a* to define three container-receiving spaces 239 in the front interior space 110*a* of the carrier 105, and the divider flaps 199*b*, 213*b* extend from the central panel 167*b* to the back panel 125*b* and the attachment flaps 203*b*, 219*b* are folded into at least partial face-to-face contact with the back panel 125*b* to define three container-receiving spaces 241 in the back interior space 110*b* of the carrier 105.

The bottom panels 177, 223 can be folded toward each other at respective fold lines 179*a*, 179*b*. The respective primary locking tab projections 227 can be at least partially separated from the bottom panel 223 along the line of weakening 230 and/or the cuts 231 and at least partially inserted into the respective openings 195 to form a primary lock of the carrier 105. The respective secondary locking tab projections 233, 235 of the bottom panel 223 can be folded at respective fold lines 237 or can remain in a substantially planar configuration relative to the remainder of the bottom panel 223 and extend into the respective slits 183, 185 and/or respective openings formed by movement of the opening flaps 187, 189 relative to the bottom panel 177 to form a secondary lock of the carrier 105. Such an arrangement of a primary lock and a secondary lock contributes to a substantially secure arrangement of the bottom panels 177, 223 for example, to resist relative movement of the bottom panels 177, 223 such as separation and/or lateral shifting. The bottom panels 117, 223 can be provided with a different closure configuration without departing from the disclosure.

The overlap and contact of various portions of the blank 103 as described herein can be accomplished with an adhesive such as glue, or, in embodiments, through alternative closures such as tabs and slots. In embodiments, the aforementioned steps in forming the carrier 105 from the blank 103 can be performed differently, for example, in a different order, to form the carrier 105.

As shown, the interior spaces 110*a*, 110*b* are each defined by a distance D corresponding to a distance that the front panel 125*a* is positioned from the central panel 167*a* as well as a distance that the back panel 125*b* is positioned from the central panel 167*b*, and with the lengths L1, L2 (FIG. 1) of the divider flaps 199*a*, 213*a*, 199*b*, 213*b* being greater than the distance D. In one embodiment, one or more of the divider flaps 199*a*, 213*a*, 199*b*, 213*b* is curved so as to curvedly extend from the respective central panel 167*a*, 167*b* to the respective panel 125*a*, 125*b* and to define a radius of curvature along at least a portion thereof that is equal to about half of D, i.e., D/2. The divider flaps 199*a*, 213*a*, 199*b*, 213*b* could be otherwise shaped, arranged, and/or configured without departing from the disclosure.

In this regard, the divider flaps 199*a*, 213*a*, 199*b*, 213*b* are positioned to extend between the central panels 167*a*, 167*b* and the front or back panel 125*a*, 125*b* with a generally curved configuration. In particular, in order to accommodate the spacing D between the front panel 125*a* and the central panel 167*a* as well as the back panel 125*b* and the central panel 167*b*, the divider flaps 199*a*, 213*a*, 199*b*, 213*b* at least partially curve, bend, fold and/or flex upon formation or erection of the carrier 105. As such, the divider flaps 199*a*, 213*a*, 199*b*, 213*b* are at least partially reconfigurable toward a generally curved configuration so as to accommodate the spacing D of the interior spaces 110*a*, 110*b* as compared to, for example, conventional divider flaps having a straight configuration that is not reconfigurable so as to have interior spaces with a spacing greater than D. Further, when the containers C are disposed in the carrier 105, the divider flaps 199*a*, 213*a*, 199*b*, 213*b* can closely engage or approximate the curvature of a respective adjacent container C, for example, to minimize free space in the interior spaces 110*a*, 110*b* of the carrier 105. In one embodiment, one or more of the divider flaps 199*a*, 213*a*, 199*b*, 213*b* can include one or more lines of weakening to facilitate such curvature, bending, folding, and/or flexing.

As also shown, the curved corners 223, 225, 227, 229 of the carrier 105 provide a visually distinctive configuration of the carrier 105 to allow customers to readily identify the carrier 105 among other retail products. Furthermore, the containers C disposed in the outermost container-receiving spaces 239, 241 adjacent the respective curved corners 223, 225, 227, 229 are closely engaged, e.g., contoured, by the respective curved corners 223, 225, 227, 229, for example, to minimize empty space in the carrier 105 so as to optimize storage and/or shipping operations and to provide a stable arrangement of the containers C in the carrier 105.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, comprising:

a plurality of panels at least partially extending around an interior space of the carrier, the plurality of panels includes a front panel, a back panel, at least one central panel, at least one side panel, and at least one bottom panel, the at least one central panel positioned a distance from one of the front panel and the back panel;

at least one curved corner; and at least one curved divider flap extending from the at least one central panel to one of the front panel and the back panel in the interior space of the carrier, the at least one curved divider flap whose curvature begins approximately half the distance from the at least one central panel to the one of the front panel and the back panel, the at least one curved divider flap defines a radius of curvature between the at least one central panel and the one of the front panel and the back panel, the radius of curvature being approximately half the distance from the at least one central panel to the one of the front panel and the back panel.

2. The carrier of claim 1, wherein the at least one curved divider flap at least partially defines a plurality of container-receiving spaces for receiving respective containers of the plurality of containers.

3. The carrier of claim 2, wherein the at least one curved divider flap is configured for contouring a portion of one or more containers of the plurality of containers.

4. The carrier of claim 2, wherein the at least one curved divider flap is a first curved divider flap, and the at least one curved divider flap further comprises a second curved divider flap extending from the at least one central panel to the one of the front panel and the back panel.

5. The carrier of claim 2, wherein the at least one central panel is a front central panel, the at least one curved divider flap is a first curved divider flap extending from the front central panel to the front panel and defining a plurality of container-receiving spaces in a front interior space of the carrier, the at least one central panel further comprises a back central panel, and the at least one curved divider flap further comprises a second curved divider flap extending from the back central panel to the back panel and defining a plurality of container-receiving spaces in a back interior space of the carrier.

6. The carrier of claim 5, wherein the at least one curved divider flap further comprises a third curved divider flap extending from the front central panel to the front panel and a fourth curved divider flap extending from the back central panel to the back panel.

7. The carrier of claim 1, wherein the at least one curved corner is a first curved corner, and the at least one curved corner further comprises a second curved corner.

8. The carrier of claim 7, wherein the at least one side panel is a first side panel and the at least one side panel further comprises a second side panel, the first curved corner is foldably connected to each of the first side panel and the one of the front panel and the back panel, and the second curved corner is foldably connected to each of the second side panel and the one of the front panel and the back panel.

9. The carrier of claim 8, wherein the first side panel is a first front side panel, the second side panel is a second front side panel, the at least one side panel further comprises a first back side panel and a second back side panel, the at least one curved corner further comprises a third curved corner foldably connected to the each of the second back side panel and the back panel, and the at least one curved corner further comprises a fourth curved corner foldably connected to each of the first back side panel and the back panel.

10. The carrier of claim 1, wherein the plurality of panels further comprises at least one end panel.

11. The carrier of claim 10, wherein the carrier further comprises a handle and the at least one end panel is spaced apart from the handle.

12. The carrier of claim 11, wherein the handle comprises an upper portion of the at least one central panel and at least one handle reinforcement flap in at least partial face-to-face contact with the upper portion of the at least one central panel.

13. The carrier of claim 11, wherein the at least one end panel is spaced apart from the at least one central panel.

14. The carrier of claim 1, wherein the at least one central panel is a front central panel and the at least one central panel further comprises a back central panel, the at least one side panel is a first front side panel and the at least one side panel further comprises a second front side panel, a first back side panel, and a second back side panel, the at least one curved corner is a first curved corner foldably connected to each of the first front side panel and the front panel, the at least one curved corner further comprises a second curved corner foldably connected to each of the second front side panel and the front panel, a third curved corner foldably connected to the each of the second back side panel and the back panel, and a fourth curved corner foldably connected to each of the first back side panel and the back panel, the at least one curved divider flap is a first curved divider flap extending from the front central panel to the front panel and defining a plurality of container-receiving spaces in a front interior space of the carrier, and the at least one curved divider flap further comprises second curved divider flap extending from the back central panel to the back panel and defining a plurality of container-receiving spaces in a back interior space of the carrier.

15. The carrier of claim 14, wherein the at least one curved divider flap further comprises a third curved divider flap extending from the front central panel to the front panel and a fourth curved divider flap extending from the back central panel to the back panel.

16. The carrier of claim 15, wherein the plurality of panels further comprises a first end panel in at least partial face-to-face contact with a second end panel, each end panel is spaced apart from the handle.

17. The carrier of claim 1, wherein the at least one curved corner comprises a plurality of parallel fold lines.

18. A blank for forming a carrier for holding a plurality of containers, comprising:

a plurality of panels for at least partially extending around an interior space of the carrier formed from the blank, the plurality of panels includes a front panel, a back panel, at least one central panel, at least one side panel, and at least one bottom panel, the at least one central panel for being positioned a distance from one of the front panel and the back panel when the carrier is formed from the blank;

at least one corner portion for forming at least one curved corner of the carrier formed from the blank; and at least one divider flap for curvedly extending from the at least one central panel to one of the front panel and the back panel in the interior space of the carrier formed from the blank, the at least one curved divider flap whose curvature begins approximately half the distance from the at least one central panel to the one of the front panel and the back panel when the carrier is formed from the blank, the at least one curved divider flap for having a radius of curvature between the at least one central panel and the one of the front panel and the back panel of approximately half the distance from the at least one central panel to the one of the front panel and the back panel when the carrier is formed from the blank.

19. The blank of claim 18, wherein the at least one divider flap is a first divider flap, and the at least one divider flap further comprises a second divider flap for curvedly extending from the at least one central panel to the one of the front panel and the back panel in the carrier formed from the blank.

20. The blank of claim 18, wherein the at least one central panel is a front central panel, the at least one divider flap is a first divider flap for curvedly extending from the front central panel to the front panel to define a plurality of container-receiving spaces in a front interior space of the carrier formed from the blank, the at least one central panel further comprises a back central panel, and the at least one divider flap further comprises a second divider flap curvedly extending from the back central panel to the back panel to define a plurality of container-receiving spaces in a back interior space of the carrier formed from the blank.

21. The blank of claim 20, wherein the at least one divider flap further comprises a third divider flap for curvedly extending from the front central panel to the front panel in the carrier formed from the blank and a fourth divider flap for curvedly extending from the back central panel to the back panel in the carrier formed from the blank.

22. The blank of claim 18, wherein the at least one corner portion is a first corner portion for forming a first curved corner in the carrier formed from the blank, and the blank further comprises a second corner portion for forming a second curved corner in the carrier formed from the blank.

23. The blank of claim 22, wherein the at least one side panel is a first side panel and the at least one side panel further comprises a second side panel, the first corner portion is foldably connected to each of the first side panel and the one of the front panel and the back panel, and the second corner portion is foldably connected to each of the second side panel and the one of the front panel and the back panel.

24. The blank of claim 23, wherein the first side panel is a first front side panel, the second side panel is a second front side panel, the at least one side panel further comprises a first back side panel and a second back side panel, the at least one corner portion further comprises a third corner portion foldably connected to the each of the second back side panel and the back panel, and the at least one corner portion further comprises a fourth corner portion foldably connected to each of the first back side panel and the back panel.

25. The blank of claim 18, wherein the plurality of panels further comprises at least one end panel.

26. The blank of claim 25, wherein the blank further comprises handle features for forming a handle of the carrier formed from the blank, and the at least one end panel is positioned for being spaced apart from the handle in the carrier formed from the blank.

27. The blank of claim 26, wherein the handle features comprise an upper portion of the at least one central panel and at least one handle reinforcement flap in at least partial face-to-face contact with the upper portion of the at least one central panel.

28. The blank of claim 26, wherein the at least one end panel is positioned for being spaced apart from the at least one central panel in the carrier formed from the blank.

29. The blank of claim 18, wherein the at least one central panel is a front central panel and the at least one central panel further comprises a back central panel, the at least one side panel is a first front side panel and the at least one side panel further comprises a second front side panel, a first back side panel, and a second back side panel, the at least one corner portion is a first corner portion foldably connected to each of the first front side panel and the front panel, the at least one corner portion further comprises a second corner portion foldably connected to each of the second front side panel and the front panel, a third corner portion foldably connected to the each of the second back side panel and the back panel, and a fourth corner portion foldably connected to each of the first back side panel and the back panel, the at least one divider flap is a first divider flap for curvedly extending from the front central panel to the front panel to define plurality of container-receiving spaces in a front interior space of the carrier formed from the blank, and the at least one divider flap further comprises second divider flap for curvedly extending from the back central panel to the back panel to define a plurality of container-receiving spaces in a back interior space of the carrier formed from the blank.

30. The blank of claim 29, wherein the at least one divider flap further comprises a third divider flap for curvedly extending from the front central panel to the front panel in the carrier formed from the blank and a fourth divider flap for curvedly extending from the back central panel to the back panel in the carrier formed from the blank.

31. The blank of claim 30, wherein the blank further comprises handle features for forming a handle of the carrier formed from the blank, and the plurality of panels further comprises a first end panel positioned for being in at least partial face-to-face contact with a second end panel in the carrier formed from the blank such that each end panel is spaced apart from the handle.

32. The blank of claim 18, wherein the at least one corner portion comprises a plurality of parallel fold lines.

33. A method of forming a carrier for holding a plurality of containers, comprising:

obtaining a blank comprising a plurality of panels comprising a front panel, a back panel, at least one central panel, at least one side panel, and at least one bottom panel, at least one corner portion, and at least one divider flap;

folding the plurality of panels at least partially around an interior of the carrier such that the at least one central panel is positioned a distance from one of the front panel and the back panel;

curving the at least one corner portion to form at least one curved corner; and positioning the at least one divider flap to curvedly extend from the at least one central panel to one of the front panel and the back panel in the interior space of the carrier such that the at least one divider flap is curved, whose curvature begins approximately half the distance from the at least one central panel to the one of the front panel and the back panel and such that the at least one curved divider flap defines a radius of curvature between the at least one central panel and the one of the front panel and the back panel, the radius of curvature being approximately half the distance from the at least one central panel to the one of the front panel and the back panel.

34. The method of claim 33, wherein the at least one divider flap at least partially defines a plurality of container-receiving spaces for receiving respective containers of the plurality of containers.

35. The method of claim 34, wherein the at least one divider flap is configured for contouring a portion of one or more containers of the plurality of containers.

36. The method of claim 34, wherein the at least one divider flap is a first divider flap, and the at least one divider flap further comprises a second divider flap curvedly extending from the at least one central panel to the one of the front panel and the back panel.

37. The method of claim 34, wherein the at least one central panel is a front central panel, the at least one divider flap is a first divider flap curvedly extending from the front central panel to the front panel and defining a plurality of container-receiving spaces in a front interior space of the carrier, the at least one central panel further comprises a back central panel, and the at least one divider flap further comprises a second divider flap curvedly extending from the back central panel to the back panel and defining a plurality of container-receiving spaces in a back interior space of the carrier.

38. The method of claim 37, wherein the at least one divider flap further comprises a third divider flap curvedly extending from the front central panel to the front panel and a fourth divider flap curvedly extending from the back central panel to the back panel.

39. The method of claim 33, wherein the at least one curved corner is a first curved corner and the at least one corner portion is a first corner portion forming the first curved corner, and the at least one corner portion further comprises a second corner portion forming a second curved corner.

40. The method of claim 39, wherein the at least one side panel is a first side panel and the at least one side panel further comprises a second side panel, the first curved corner is foldably connected to each of the first side panel and the one of the front panel and the back panel, and the second curved corner is foldably connected to each of the second side panel and the one of the front panel and the back panel.

41. The method of claim 40, wherein the first side panel is a first front side panel, the second side panel is a second front side panel, the at least one side panel further comprises a first back side panel and a second back side panel, the at least one corner portion further comprises a third corner portion foldably connected to the each of the second back side panel and the back panel and forming a third curved corner, and the at least one corner portion further comprises a fourth corner portion foldably connected to each of the first back side panel and the back panel and forming a fourth curved corner.

42. The method of claim 33, wherein the plurality of panels further comprises at least one end panel.

43. The method of claim 42, wherein the blank further comprises handle features for forming a handle of the carrier, the at least one end panel is spaced apart from the handle.

44. The method of claim 43, wherein the handle comprises an upper portion of the at least one central panel and at least one handle reinforcement flap in at least partial face-to-face contact with the upper portion of the at least one central panel.

45. The method of claim 43, wherein the at least one end panel is spaced apart from the at least one central panel.

46. The method of claim 33, wherein the at least one central panel is a front central panel and the at least one central panel further comprises a back central panel, the at least one side panel is a first front side panel and the at least one side panel further comprises a second front side panel, a first back side panel, and a second back side panel, the at least one curved corner is a first curved corner and the at least one corner portion is a first corner portion foldably connected to each of the first front side panel and the front panel and forming the first curved corner, the at least one corner portion further comprises a second corner portion foldably connected to each of the second front side panel and the front panel and forming a second curved corner, a third corner portion foldably connected to the each of the second back side panel and the back panel and forming a third curved corner, and a fourth corner portion foldably connected to each of the first back side panel and the back panel and forming a fourth curved corner, the at least one divider flap is a first divider flap curvedly extending from the front central panel to the front panel and defining a plurality of container-receiving spaces in a front interior space of the carrier, and the at least one divider flap further comprises second divider flap curvedly extending from the back central panel to the back panel and defining a plurality of container-receiving spaces in a back interior space of the carrier.

47. The method of claim 46, wherein the at least one divider flap further comprises a third divider flap curvedly extending from the front central panel to the front panel and a fourth divider flap curvedly extending from the back central panel to the back panel.

48. The method of claim 47, wherein the plurality of panels further comprises a first end panel in at least partial face-to-face contact with a second end panel, each end panel is spaced apart from the handle.

49. The method of claim 33, wherein the at least one corner portion comprises a plurality of parallel fold lines.

* * * * *